US009317001B2

(12) United States Patent
Okamoto et al.

(10) Patent No.: US 9,317,001 B2
(45) Date of Patent: Apr. 19, 2016

(54) IMAGE FORMING APPARATUS HAVING MOVING COVER AND DETACHABLE UNIT

(71) Applicant: Brother Kogyo Kabushiki Kaisha, Nagoya (JP)

(72) Inventors: Yoshihiro Okamoto, Komaki (JP); Shougo Sato, Seto (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/636,644

(22) Filed: Mar. 3, 2015

(65) Prior Publication Data

US 2015/0277369 A1 Oct. 1, 2015

(30) Foreign Application Priority Data

Mar. 28, 2014 (JP) ..... 2014-069735

(51) Int. Cl.
*G03G 21/18* (2006.01)
*G03G 21/16* (2006.01)

(52) U.S. Cl.
CPC ..... *G03G 21/1633* (2013.01); *G03G 21/1846* (2013.01); *G03G 21/1817* (2013.01); *G03G 2221/1846* (2013.01)

(58) Field of Classification Search
CPC ..... G03G 2221/1846; G03G 15/1846
See application file for complete search history.

(56) References Cited

U.S. PATENT DOCUMENTS 5,353,100 A * 10/1994 Ohtsuka ..... B41J 2/45 399/111
2006/0034633 A1 2/2006 Tsusaka et al.
2009/0180802 A1* 7/2009 Sato ..... G03G 21/1821 399/119
2010/0303499 A1* 12/2010 Mori ..... G03G 21/1846 399/113

FOREIGN PATENT DOCUMENTS

JP 01213669 A * 8/1988
JP H03-249766 A 11/1991
JP 2006-053254 A 2/2006
JP 2009-086034 A 4/2009

* cited by examiner

*Primary Examiner* — Clayton E Laballe
*Assistant Examiner* — Leon W Rhodes, Jr.
(74) *Attorney, Agent, or Firm* — Burr & Brown, PLLC

(57) ABSTRACT

An image forming apparatus includes a housing, a cover, a process unit, and a grip portion. The housing has an opening portion defining an open end. The cover is movable between a closing position to close the open end and an opening position to open the open end. The cover defines the opening portion and has one end portion to define the open end. The process unit is configured to be attached to and detached from the housing through the opening portion. The process unit includes a developer chamber configured to accommodate therein developer. The grip portion is provided at the process unit, and has a protruding portion protruding outward between the open end and the one end portion when the process unit has been attached to the housing and the cover is at the closing position.

13 Claims, 12 Drawing Sheets

IMAGE FORMING APPARATUS HAVING MOVING COVER AND DETACHABLE UNIT

CROSS REFERENCE TO RELATED APPLICATION

This application claims priority from Japanese Patent Application No. 2014-069735 filed Mar. 28, 2014. The entire content of the priority application is incorporated herein by reference.

TECHNICAL FIELD

The present disclosure relates to an electro-photographic type image forming apparatus for forming an image onto a sheet.

BACKGROUND

Among the various conventional image forming apparatuses known in the art, one technology discloses an image forming apparatus that has a process cartridge accommodating developer. The process cartridge needs to be replaced with a new one, when the developer is used up.

When detaching a developing cartridge from a frame body of an image forming apparatus, a user needs to open a front cover formed on a front side of the apparatus, and then the user needs to insert his hand inside the apparatus body to grip the process cartridge.

Incidentally, the frame body in the present disclosure refers to a part such as a housing or a frame, which is not disassembled by a user at time of use.

SUMMARY

According to the above technology, when replacing the process cartridge to a new one, the user needs to open a moving cover such as a front cover, and then the user is required to insert his hand inside the frame body.

At least some aspects of the present disclosure provide an image forming apparatus that allows the user to access the process cartridge inside the frame body without inserting his hand inside the frame body.

According to at least one aspect of the disclosure, the present disclosure provides an image forming apparatus including a housing, a cover, a process unit, and a grip portion. The housing may have an opening portion defining an open end. The cover may be movable between a closing position to close the open end and an opening position to open the open end. The cover may define the opening portion and has one end portion to define the open end. The process unit may be configured to be attached to and detached from the housing through the opening portion. The process unit may include a developer chamber configured to accommodate therein developer. The grip portion may be provided at the process unit, and may have a protruding portion protruding outward between the open end and the one end portion when the process unit has been attached to the housing and the cover is at the closing position.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
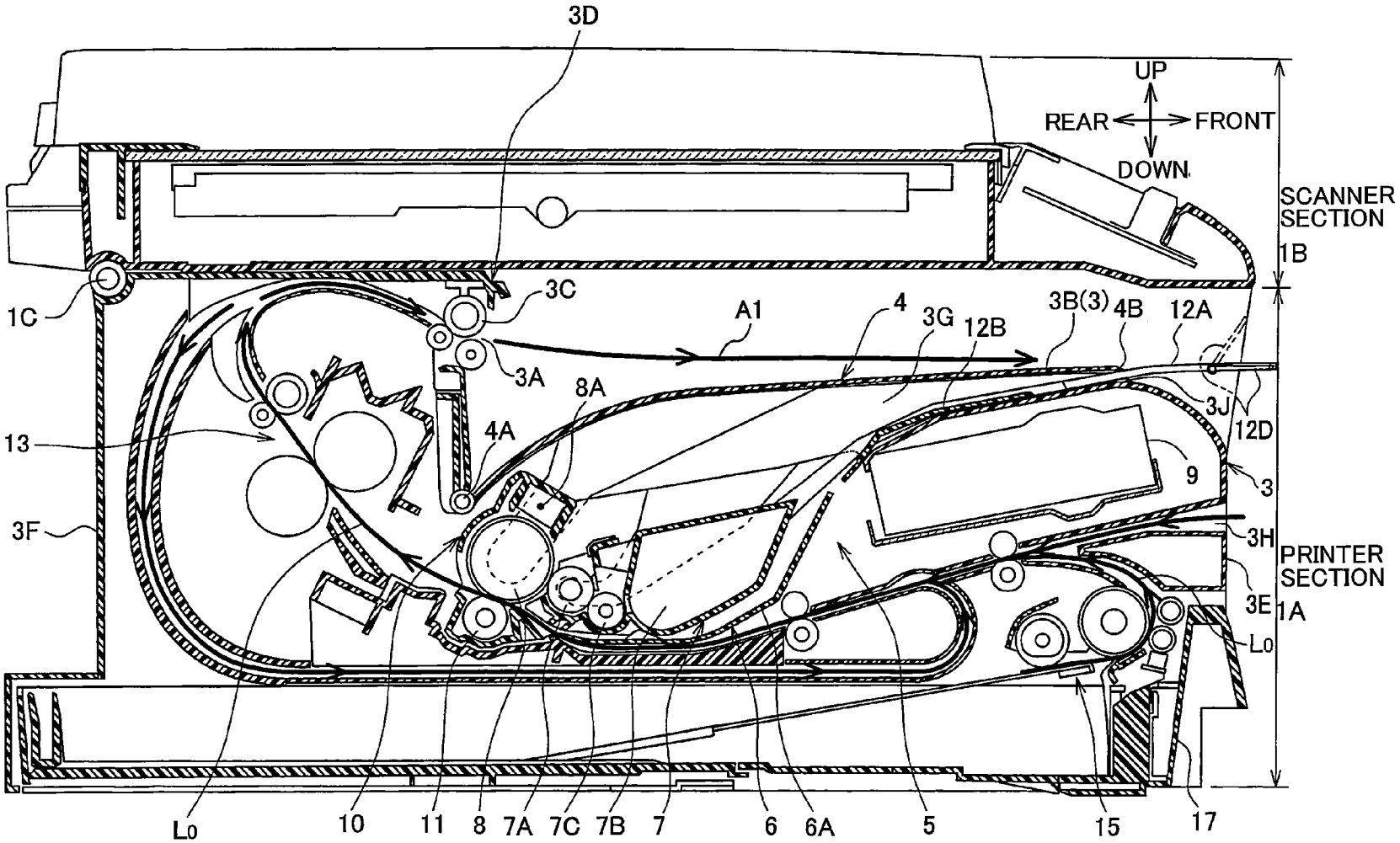
FIG. 1 is a central cross-sectional view of an image forming apparatus according to a first embodiment.

An image forming apparatus will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image forming apparatus is disposed in an orientation in which it is intended to be used. In use, the image forming apparatus is disposed as shown in FIG. 1.

First Embodiment

1. General Structure of Image Forming Apparatus

The image forming apparatus 1 according to a first embodiment is an integral apparatus including a printer section 1A and a scanner section 1B, as shown in FIG. 1. The printer section 1A is a printing device configured to form an image on sheets, such as sheets of paper. The scanner section 1B is an image reading unit configured to read images (including letters) on an original.

The scanner section 1B is disposed vertically upward of the printer section 1A. Below the scanner section 1B, a sheet discharge tray 3B is provided to accommodate printed sheets.

The scanner section 1B is connected to the printer section 1A through a hinge portion 1C, and is pivotable about the hinge portion 1C. The hinge portion 1C is provided at an upper and rear side of the printer section 1A.

Incidentally, the rear side of the printer section 1A is the opposition side of the front side, which is defined by a sheet discharging direction A1; sheets are discharged frontward to the sheet discharge tray 3B. For example, the right side of FIG. 1 indicates the front side of the printer section 1A, and the left side of FIG. 1 indicates the rear side of the printer section 1A.

2. Configuration of Printer Portion

The printer section 1A includes a housing 3 and an image forming unit 5, which is configured to form images on sheets, is provided in the housing 3. The housing 3 includes a sheet discharge tray 3B and a frame body, and forms a discharge opening 3A at an upper portion of the housing 3. The discharge opening 3A is a portion from which sheets having formed images thereon are disposed.

The sheet discharge tray 3B receives sheets disposed from the discharge opening 3A thereon. A discharge roller 3C configured to convey sheets to the sheet discharge tray 3B is provided at the discharge opening 3A. The discharge roller 3C has selectable two sheet conveying methods as follows: one method is to convey sheets to the sheet discharge tray 3B, and the other method is to reconvey sheets to the image forming unit 5 by reversing the sheet conveying direction.

The housing 3 includes a top cover 3D, one pair of side covers (not shown), a front cover 3E, and a rear cover 3F. The top cover 3D covers an upper surface in the vertical direction of the printer section 1A. The side covers respectively cover a left surface and a right surface of the printer section 1A, and serve as part of the exterior design of the printer section 1A.

The front cover 3E covers a front surface of the printer section 1A to form the exterior design of the printer section 1A. The rear cover 3F covers a rear surface of the printer section 1A to serve as part of the exterior design of the printer section 1A.

The front cover 3E includes a manual feed slot 3H. The manual feed slot 3H is an opening portion to directly supply sheets to the image forming unit 5 without employing a feeder mechanism 15, described later. Specifically, when a user inserts a sheet into the manual feed slot 3H, the image forming unit 5 forms images on the inserted sheet.

An opening 3G is formed at a portion of the top cover 3D corresponding to the sheet discharge tray 3B. The opening 3G has an upper open end in the vertical direction. The opening 3G can be closed by a movable cover 4. The movable cover 4 is movable between a closing position to close the opening 3G and an opening position to open the opening 3G. The movable cover 4 is an example of a cover.

The movable cover 4 is connected to the top cover 3D through a hinge portion 4A so that one end portion of the movable cover 4 is pivotable about another end portion of the movable cover 4. The gravity force applied to the movable cover 4 moves the movable cover 4 toward the closing position. Thus, in a normal state, the movable cover 4 is positioned at the closing position to close the opening 3G.

An upper surface of the movable cover 4 constitutes at least a part of the sheet discharge tray 3B on which the sheet is placed. The movable cover 4, i.e., the sheet discharge tray 3B forms a slope that descends lower toward the discharge opening 3A. The hinge portion 4A is provided at a lowermost end portion of the movable cover 4, in other words, the hinge portion 4A is provided at an end portion of the movable cover 4 on the discharge opening 3A side.

The image forming unit 5 is a unit employing an electrophotographic method, in which developer is transferred onto sheets. The image forming unit 5 includes a process unit 6, an exposure unit 9, a transfer unit 11, and a fixing unit 13. The process unit 6 is detachable from the frame body of the apparatus via the opening 3G.

That is, a user can detach the process unit 6 being mounted to the frame body through the opening 3G; the user can also attach the process unit 6 to the frame body through the opening 3G.

The opening 3G has an open end upward of the process unit 6 that is mounted to the frame body in the vertical direction. Accordingly, the movable cover 4, i.e., the sheet discharge tray 3B is positioned upward of the process unit 6 in the vertical direction.

Figure 2A:
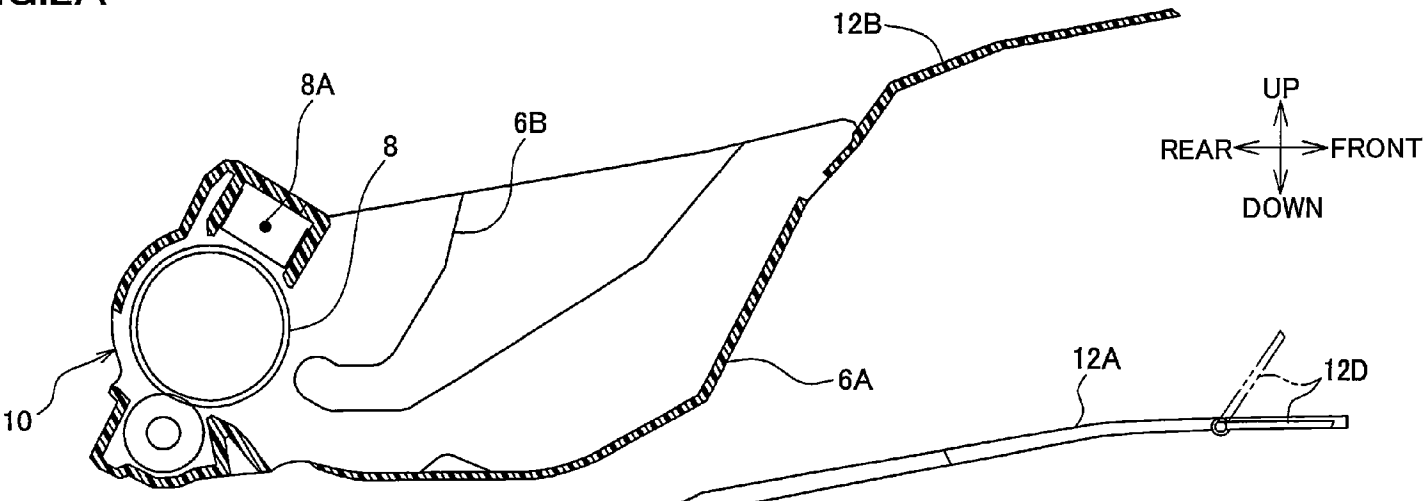
FIG. 2A is a cross-sectional view of a support member according to the first embodiment.
Figure 2B:
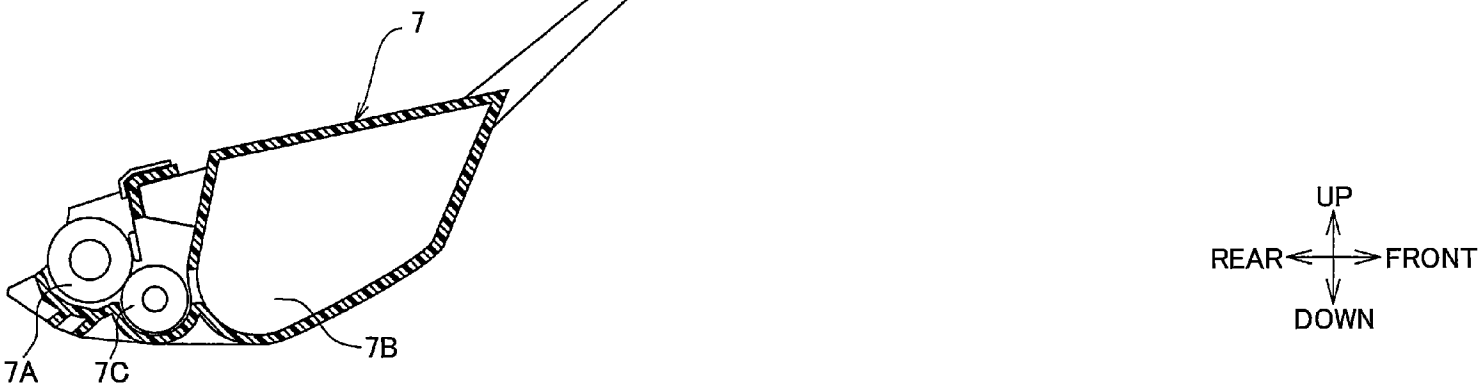
FIG. 2B is a cross-sectional view of a developer cartridge according to the first embodiment.

The process unit 6 is an integral unit including a developer cartridge 7 shown in FIG. 2B and a drum cartridge 10 shown in FIG. 2A. The process unit 6 includes a support member 6A, and the developer cartridge 7 and the drum cartridge 10 are integrated by the support member 6A. The developer cartridge 7 is detachably disposed on the support member 6A. The drum cartridge 10 is undetachable from the support member 6A, and is integrally provided in the support member 6A.

The developer cartridge 7 includes a developing roller 7A, a supply roller 7C, and a developer chamber 7B, as shown in FIG. 2B. The developer chamber 7B accommodates developer, which is supplied to a photosensitive drum 8. The developing roller 7A and the supply roller 7C supply the photosensitive drum 8 with the developer accommodated in the developer chamber 7B.

The drum cartridge 10 includes a photosensitive drum 8 and a charger 8A. Specifically, the process unit 6 includes the photosensitive drum 8, the charger 8A, the developing roller 7A, the supply roller 7C, and the developer chamber 7B. That is, the developer chamber 7B is detachable from the frame body as the entire unit, the process unit 6. Additionally, the developer chamber 7B is detachable from the frame body as the entire unit, the developer cartridge 7. Therefore, the developer chamber 7B is detachable from the frame body as the process unit 6 and as the developer cartridge 7.

The photosensitive drum 8 is a photosensitive body carrying a developer image thereon. The charger 8A charges the photosensitive drum 8. The charged photosensitive drum 8 is then exposed to a laser beam emitted from the exposure unit 9. As a result of the exposure to the laser, the photosensitive drum 8 has an electrostatic latent image thereon. Incidentally, the exposure unit 9 according to the embodiment exposes the photosensitive drum 8 to the laser beam emitted from the exposure unit 9 and scans the photosensitive drum 8.

When the developer is supplied to the photosensitive drum 8, on which the electrostatic latent image is formed, a developer image is formed on the photosensitive drum 8. A transfer unit 11 is disposed at an opposing position to the photosensitive drum 8 as shown in FIG. 1. The transfer unit 11 transfers the developer image on the photosensitive drum 8 to a sheet.

The fixing unit 13 directly or indirectly heats the developer transferred onto the sheet, and fixes the developer image on the sheet. A feeder mechanism 15 is provided upstream of the image forming unit 5 in the sheet conveying direction.

The feeder mechanism 15 feeds sheets accommodated in the sheet supply tray 17 to the image forming unit 5 one by one. The sheet supply tray 17 is detachably installed vertically downward of the process unit 6 in the frame body.

According to the embodiment as shown in FIG. 1, the exposure unit 9 and the process unit 6, in that order, are arranged from the front side, and are disposed vertically downward of the movable cover 4, which composes the sheet discharge tray 3B. Specifically, the exposure unit 9, the developer chamber 7B, the supply roller 7C, the developing roller 7A, the photosensitive drum 8, and the fixing unit 13, in that order, are arranged from the front side.

As illustrated in FIG. 1, when being projected to a virtual vertical plane parallel to a sheet discharge direction, a sheet conveying path Lo extending from the sheet supply tray 17 to the sheet discharge tray 3B forms an S-shape having two curves. A first curve is positioned downward of the exposure unit 9 in the vertical direction and a second curve is positioned downstream of the photosensitive drum 8 in the sheet conveying direction. The exposure unit 9 is positioned downward of a first holding portion 12A, described later.

3. Attachment/Detachment of Process Unit 3.1 Configuration of Process Unit

Figure 3:
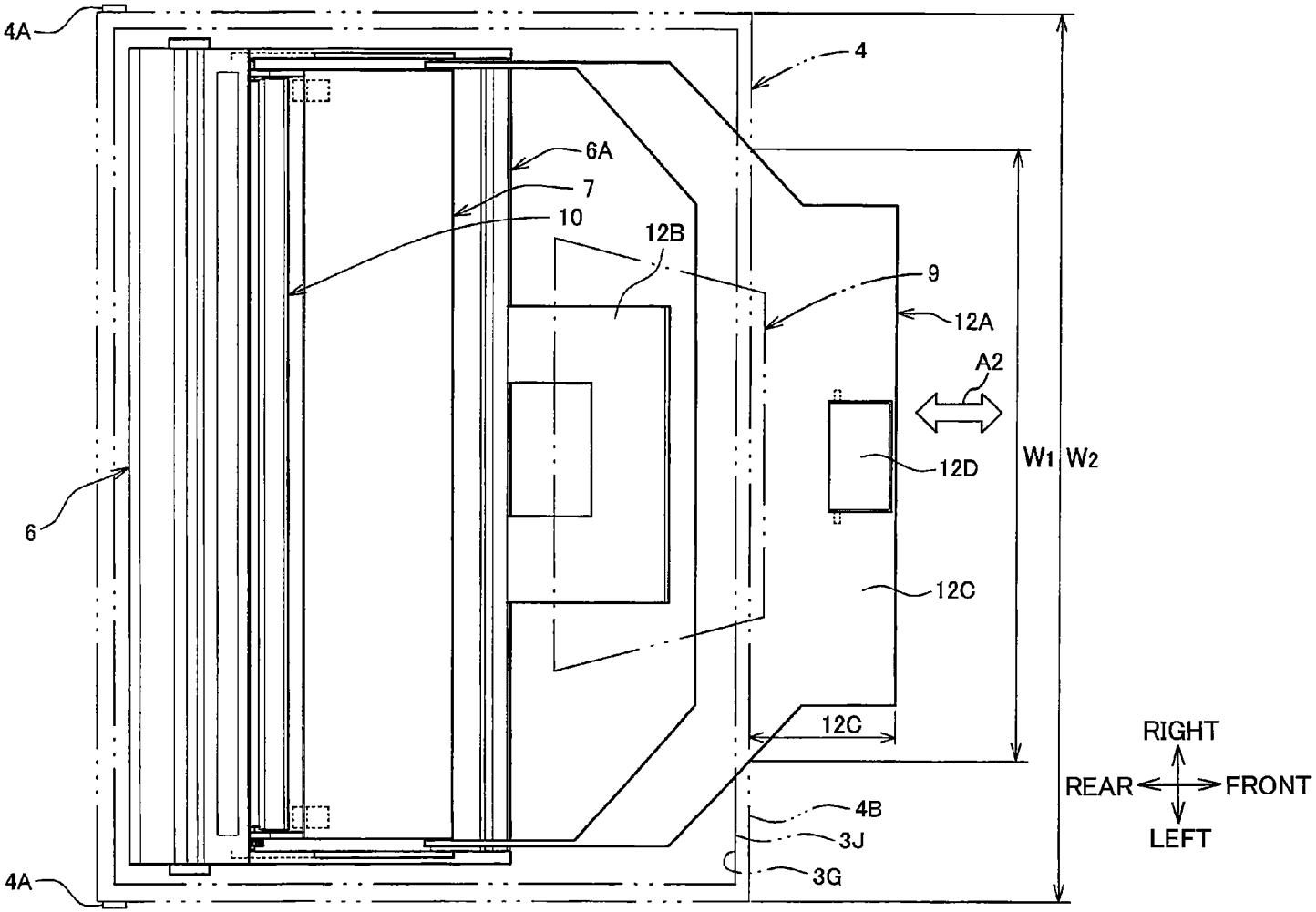
FIG. 3 is an upper view of a process unit according to the first embodiment.

As illustrated in FIG. 3, the first holding portion 12A and a second holding portion 12B are provided to the process unit 6. Each of the first and second holding portions 12A and 12B is a portion that a user holds when the user detaches the process unit 6 from the frame body. The first holding portion 12A is an example of a grip portion.

The first holding portion 12A is provided to the developer cartridge 7. The second holding portion 12B is provided to the support member 6A. Thus, when detaching only the developer cartridge 7 from the frame body, the user holds the first holding portion 12A to pull out the first holding portion 12A forward.

When detaching the process unit 6, i.e., the developer cartridge 7 and the drum cartridge 10 from the frame body, the user holds the second holding portion 12B to pull out the second holding portion 12B forward.

As illustrated in FIG. 3, the first and second holding portions 12A and 12B are positioned offset from each other in an attachment/detachment direction A2 (the frontward/rearward direction in the present embodiment) of the process unit 6, so that the user can hold only one of the first and second holding portions 12A and 12B.

As illustrated in FIG. 1, in a state where the process unit 6 is installed in the frame body and where the opening 3G is closed by the movable cover 4, at least a part of the first holding portion 12A protrudes outward from between an edge portion 3J of the opening 3G and end portion 4B of the movable cover 4.

That is, as illustrated in FIG. 3, the movable cover 4 has the hinge portion 4A at its rear end, and the front end portion 4B extends to a position coinciding with the front side edge portion 3J of the opening 3G or a position offset forward or backward from the edge portion 3J.

The first holding portion 12A extends frontward beyond the end portion 4B of the movable cover 4 and reaches to the front cover 3E. In the present embodiment, the first holding portion 12A has a portion that extends frontward beyond the front cover 3E, and hereinafter, this portion is referred to as a protruding portion 12C.

The protruding portion 12C of the first holding portion 12A forms at least a part of the sheet discharge tray 3B. The protruding portion 12C includes a regulation wall 12D. The regulation wall 12D is a stopper for regulating movement of the sheet discharged onto the sheet discharge tray 3B.

Specifically, as illustrated in FIG. 1, a wall surface of the regulation wall 12D can be moved between a position crossing the sheet discharge direction as indicated by a long dashed double-short dashed line and a position parallel to the sheet discharge direction illustrated by solid lines.

In a state where the regulation wall 12D crosses the sheet discharge direction, the front end of the discharged sheet from the discharge opening 3A collides with the regulation wall 12D, so that the movement of the discharged sheet on the sheet discharge tray 3B is regulated.

As illustrated in FIG. 3, the first holding portion 12A has a leading end in a protruding direction that is positioned frontward of the exposure unit 9, when viewed in the vertical direction. In other words, the leading end of the protruding portion 12C is located frontward of the exposure unit 9, when projected to an imaginary horizontal plane.

A width dimension W1 of the protruding portion 12C, i.e. a portion of the first holding portion 12A that constitutes at least a part of the sheet discharge tray 3B is set smaller than a width dimension W2 of the movable cover 4, i.e. the sheet discharge tray 3B.

3.2 Attachment/Detachment Operation of Process Unit

<Detachment of Developer Cartridge>

Figure 4:
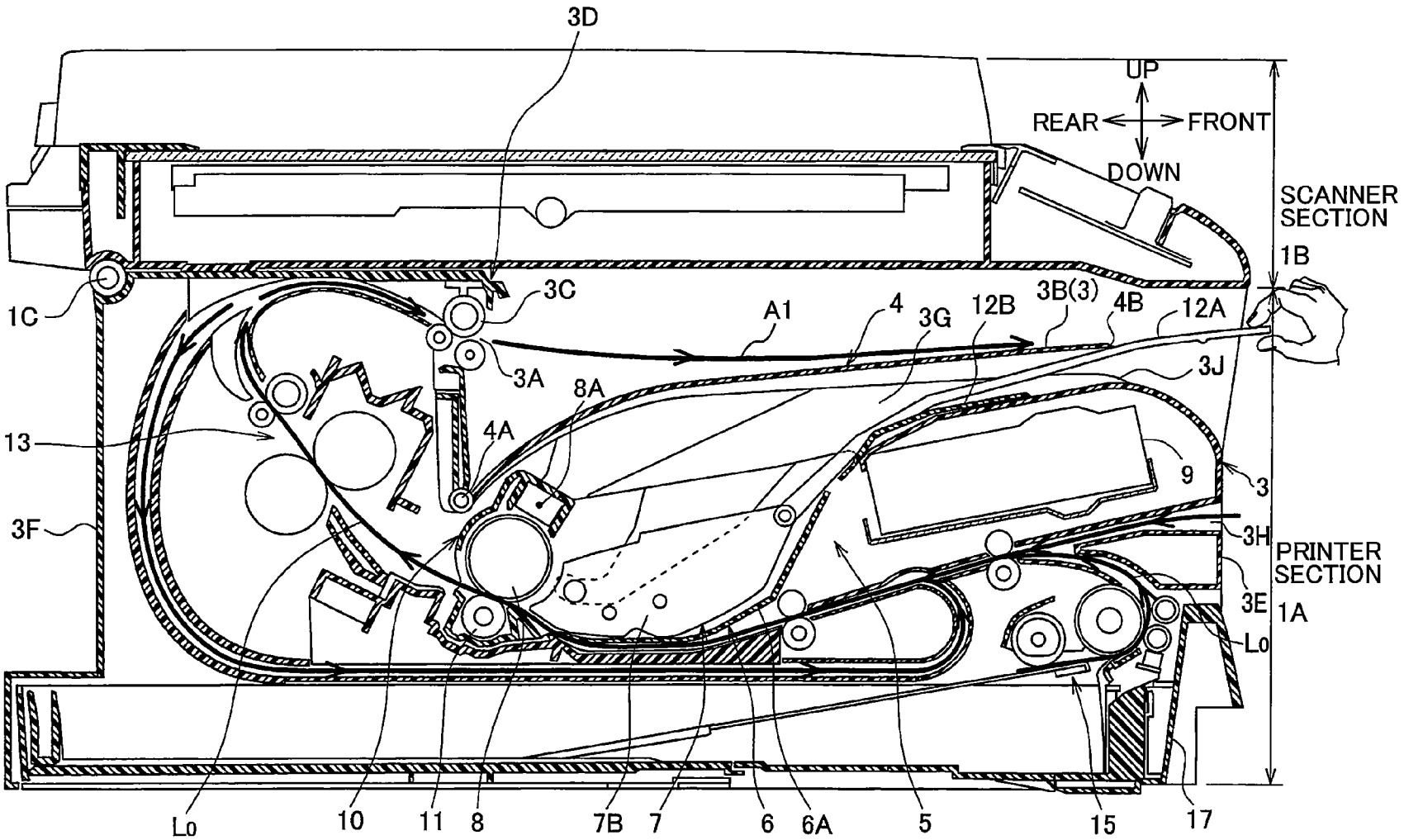
FIG. 4 is a central cross-sectional view of the image forming apparatus according to the first embodiment.
Figure 5:
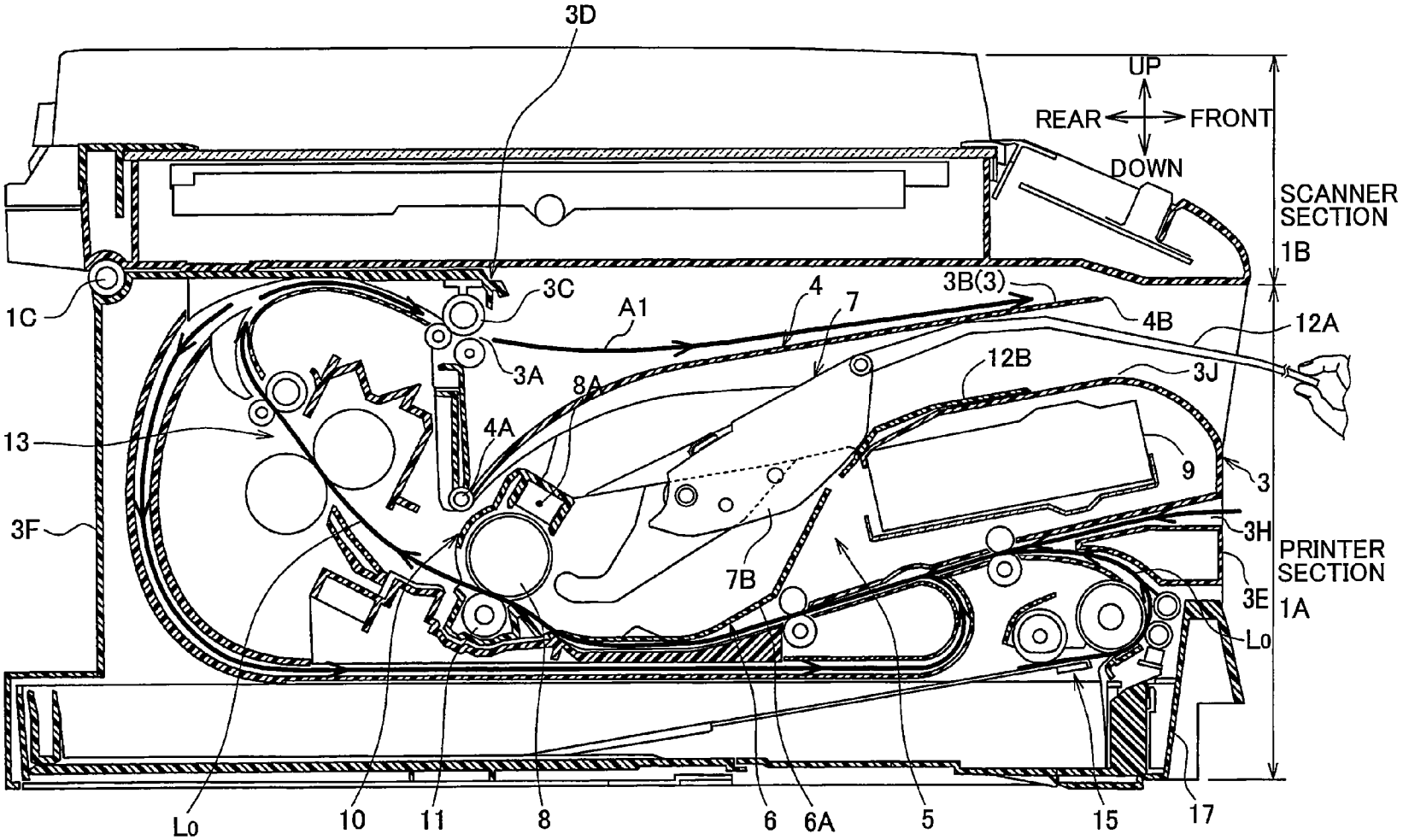
FIG. 5 is a central cross-sectional view of the image forming apparatus according to the first embodiment.
Figure 6:
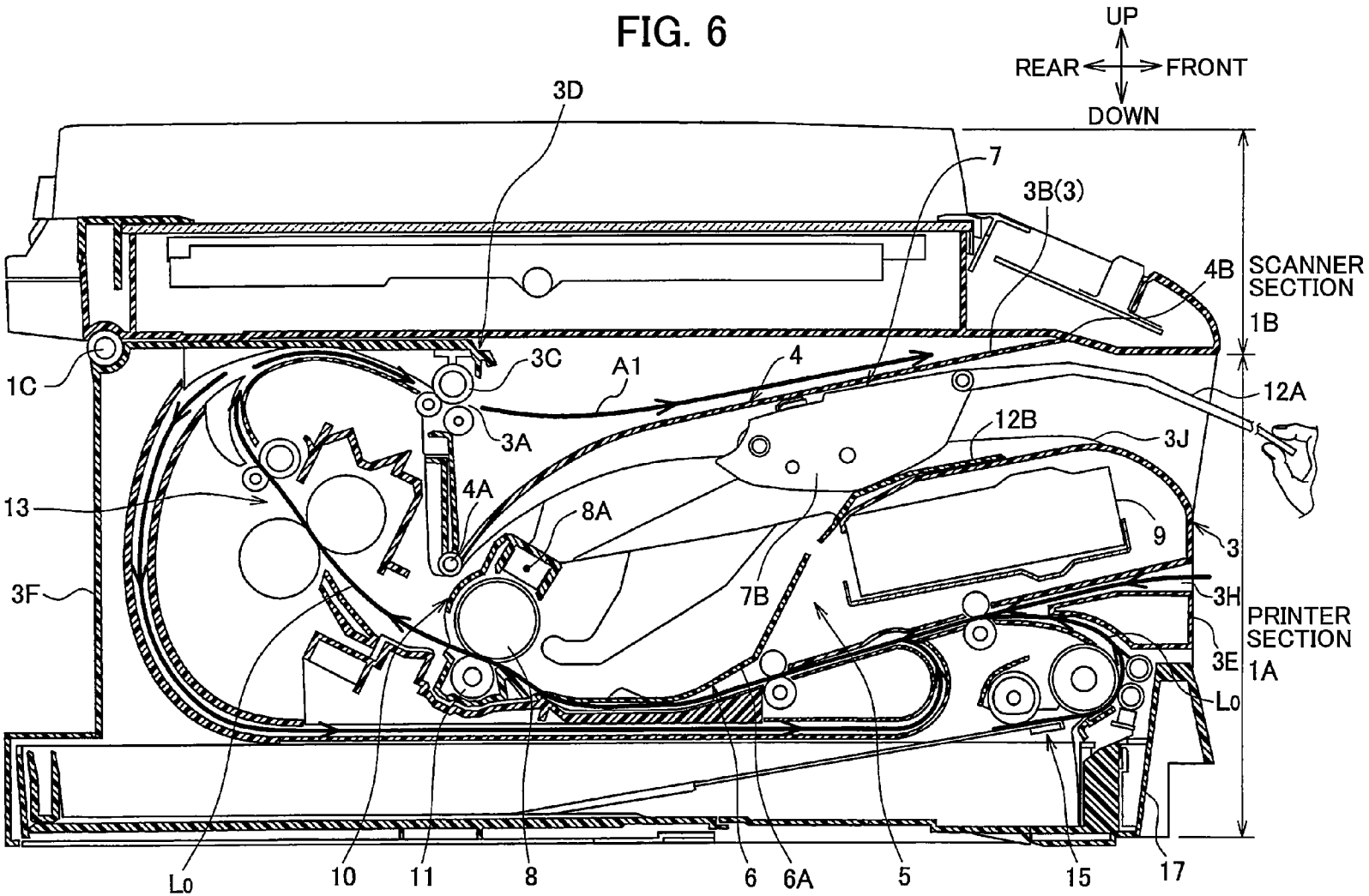
FIG. 6 is a central cross-sectional view of the image forming apparatus according to the first embodiment.

In detaching the developer cartridge 7, a user holds the first holding portion 12A to pull out the first holding portion 12A forward, as illustrated in FIG. 4. Thus, as illustrated in FIGS. 4 to 6, with movement of the developer cartridge 7, the movable cover 4 is pressed upward from inside by the developer cartridge 7 to be automatically opened. Thus, the user can detach the developer cartridge 7 from the frame body without opening the movable cover 4.

In attaching the developer cartridge 7 to the frame body, the user swings the scanner section 1B about the hinge portion 1C rearward so as to separate the scanner section 1B from the printer section 1A.

When the user lifts up the movable cover 4 while holding the end portion 4B of the movable cover 4, the movable cover 4 pivots upward in the vertical direction about the hinge portion 4A to open the opening 3G. In this state, the user can attach the developer cartridge 7 to the frame body through the opening 3G.

A first guide portion 6B (see FIG. 2A) is provided in the support member 6A. When the developer cartridge 7 is attached to the support member 6A, both end portions of a shaft of the developing roller 7A are guided by the first guide portion 6B, whereby the developer cartridge 7 is led to a predetermined position.

4. Features of Image Forming Apparatus According to Present Embodiment

In the present embodiment, the user can hold the first and second holding portions 12A and 12B without opening the movable cover 4 and without inserting his hand through the opening 3G. Thus, the developer cartridge 7 and the drum cartridge 10 can be detached from the frame body without opening the movable cover 4.

The first and second holding portions 12A and 12B are provided at an end portion of the movable cover 4 on a side opposite to the hinge portion 4A. Accordingly, when the developer cartridge 7 and the drum cartridge 10 are detached from the frame body, the movable cover 4 can be easily displaced to a position allowing passage of the cartridges 7 and 10. Thus, the developer cartridge 7 and drum cartridge 10 can be easily detached from the frame body.

In the present embodiment, the scanner section 1B is provided so as to face the opening 3G of the printer section 1A. Further, the process unit 6 is positioned rearward of the exposure unit 9. That is, the user may hardly visually recognize the process unit 6.

However, in the present embodiment, the first holding portion 12A has the protruding portion 12C at its front end portion, so that visibility of the first holding portion 12A, i.e. a portion the user holds, is improved. Accordingly, usability of the process unit 6 in the removing process is improved.

In the present embodiment, when the sheets with formed images are discharged onto the sheet discharge tray 3B, the sheet movement is regulated by the regulation wall 12D.

Accordingly, the first holding portion 12A positioned forward of the sheet discharge tray 3B is not hidden by the sheet. Thus, visibility of the first holding portion 12A is improved, whereby the replacement workability of the process unit 6 can be improved.

In the present embodiment, the movable cover 4 moves down by its own weight to close the opening 3G after detachment of the process unit 6 from the printer section 1A, so that dust and the like can be prevented from entering inside the frame body.

Second Embodiment

Figure 7A:
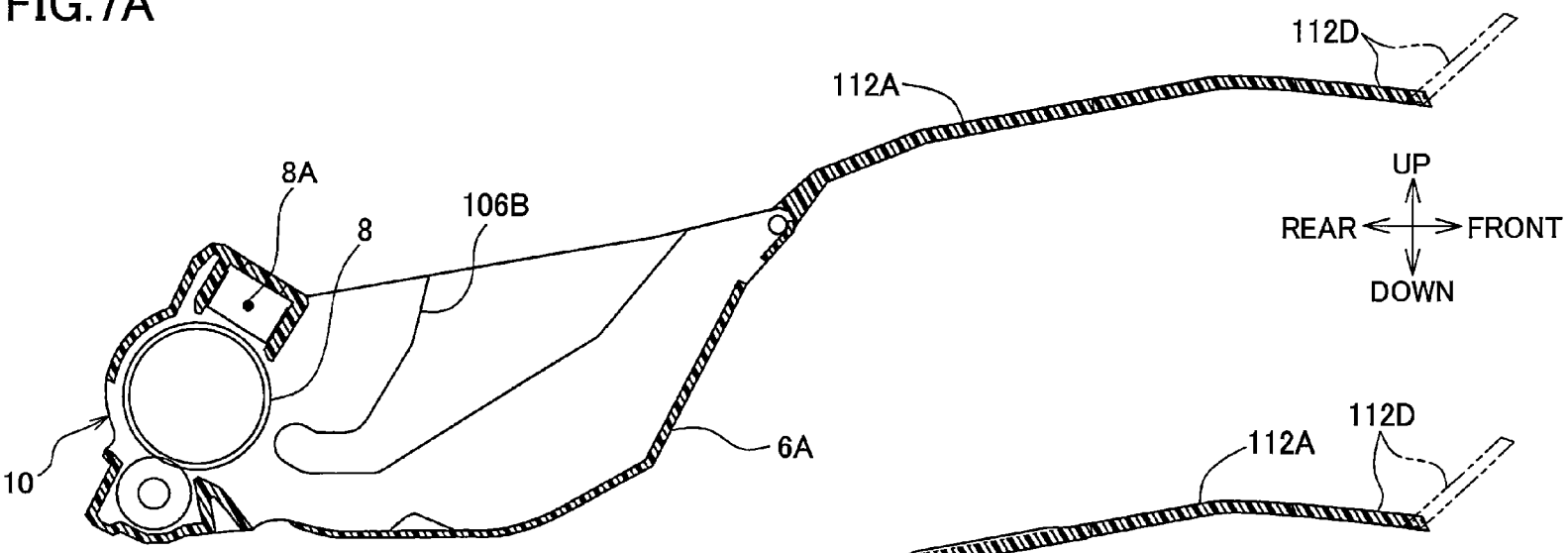
FIG. 7A is a cross-sectional view of a support member according to a second embodiment.
Figure 7B:
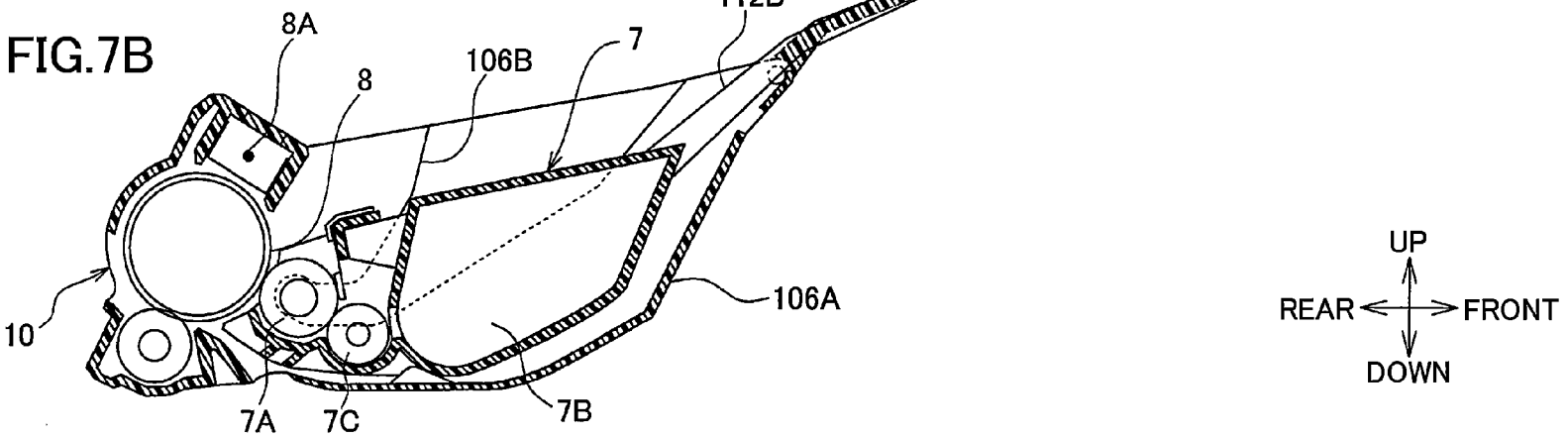
FIG. 7B is a cross-sectional view of a process unit according to the second embodiment.

As illustrated in FIGS. 7A and 7B, in the second embodiment, the first holding portion 112A is provided to the support member 106A, and the second holding portion 12B is provided to the developer cartridge 7.

Figure 8:
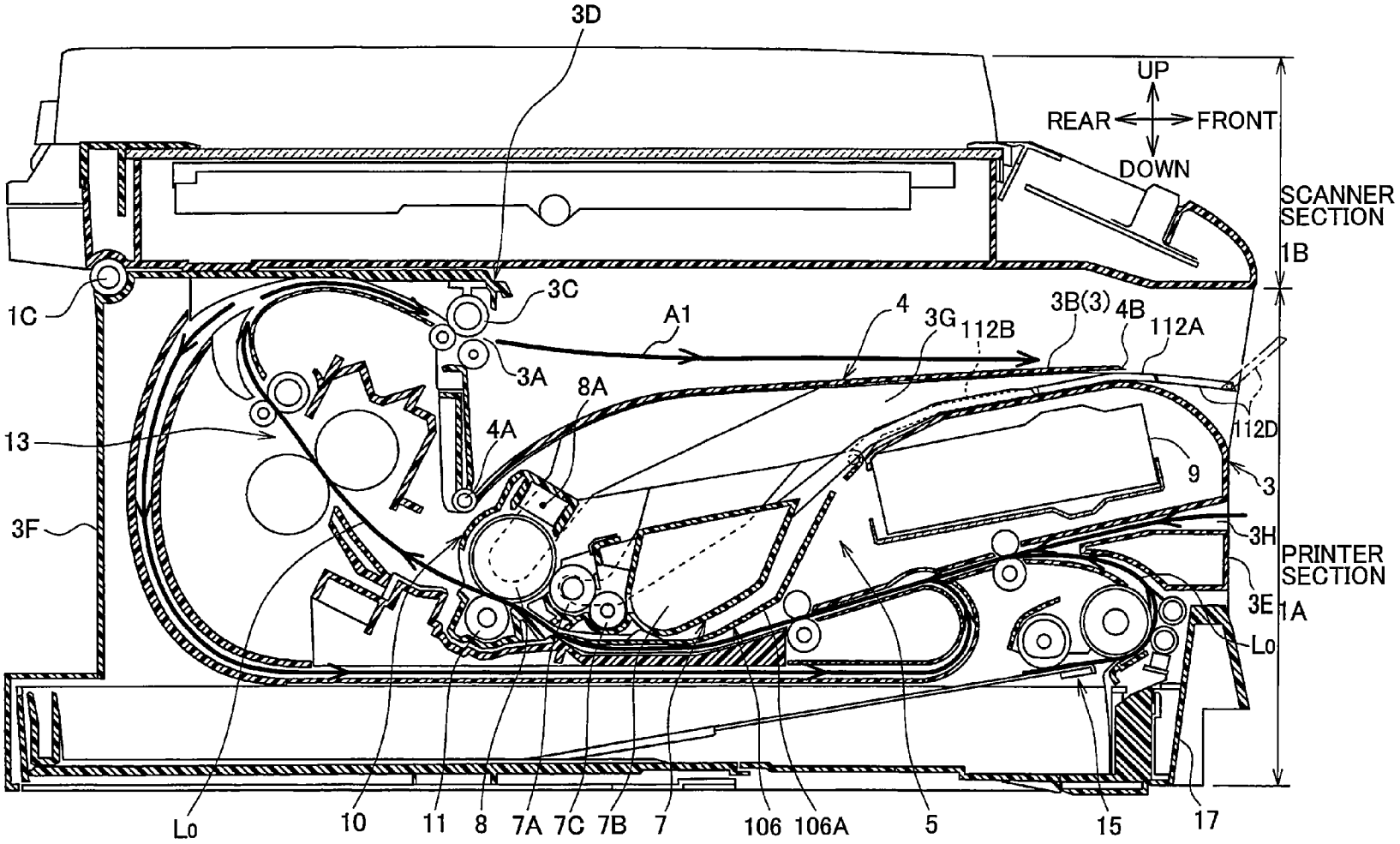
FIG. 8 is a central cross-sectional view of an image forming apparatus according to the second embodiment.

As illustrated in FIG. 8, the second holding portion 12B provided in the developer cartridge 7 does not protrude outward from the movable cover 4. In the present embodiment, the developer cartridge 7 can be detached by the following method.

<Detachment of Process Unit (Drum Cartridge)>

Detachment of the process unit (drum cartridge 10) has the same meaning as detachment of the support member 106A from the frame body. Thus, as illustrated in FIG. 9, the user holds the second holding portion 112B to pull out the second holding portion 112B forward.

Figure 9:
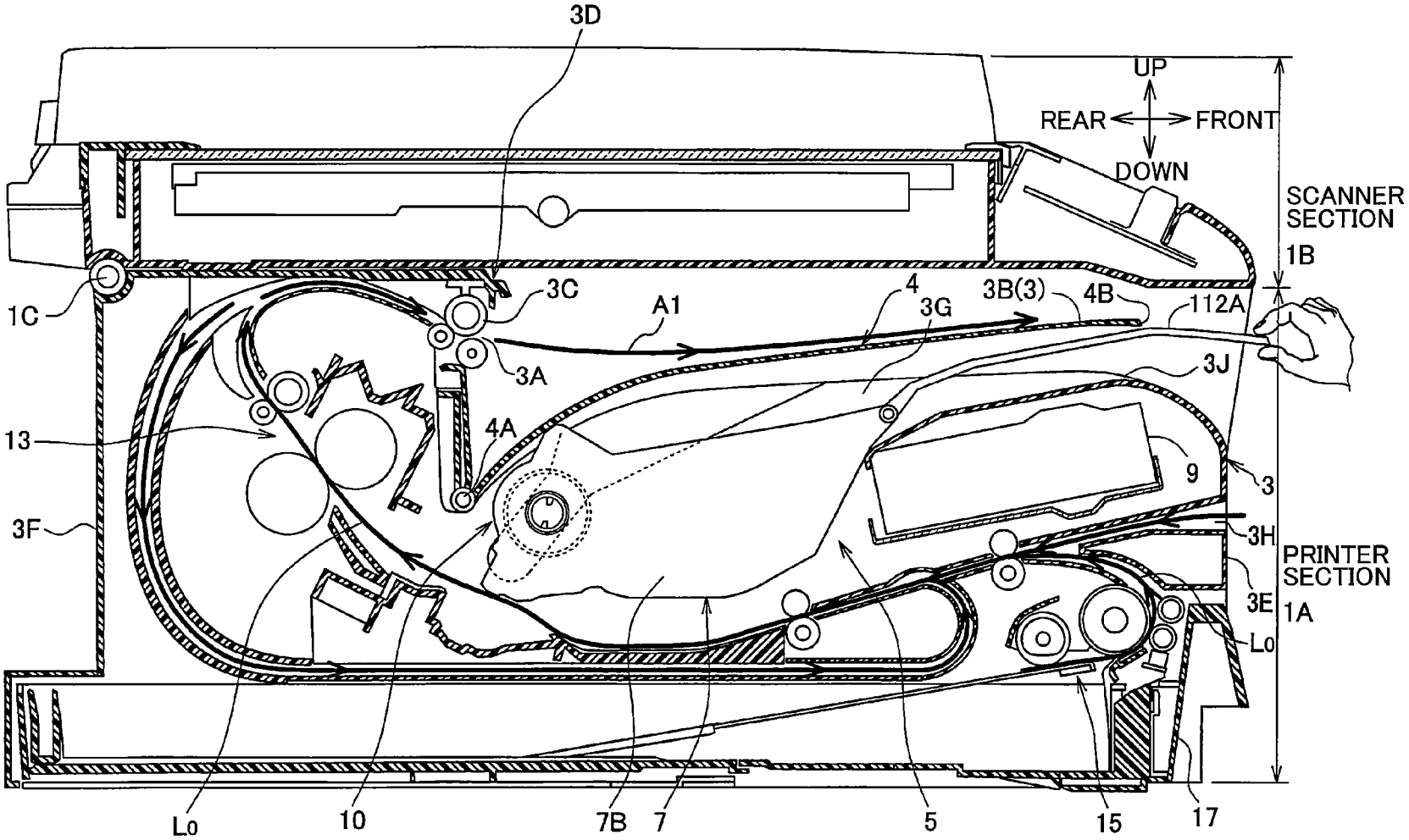
FIG. 9 is a central cross-sectional view of the image forming apparatus according to the second embodiment.
Figure 10:
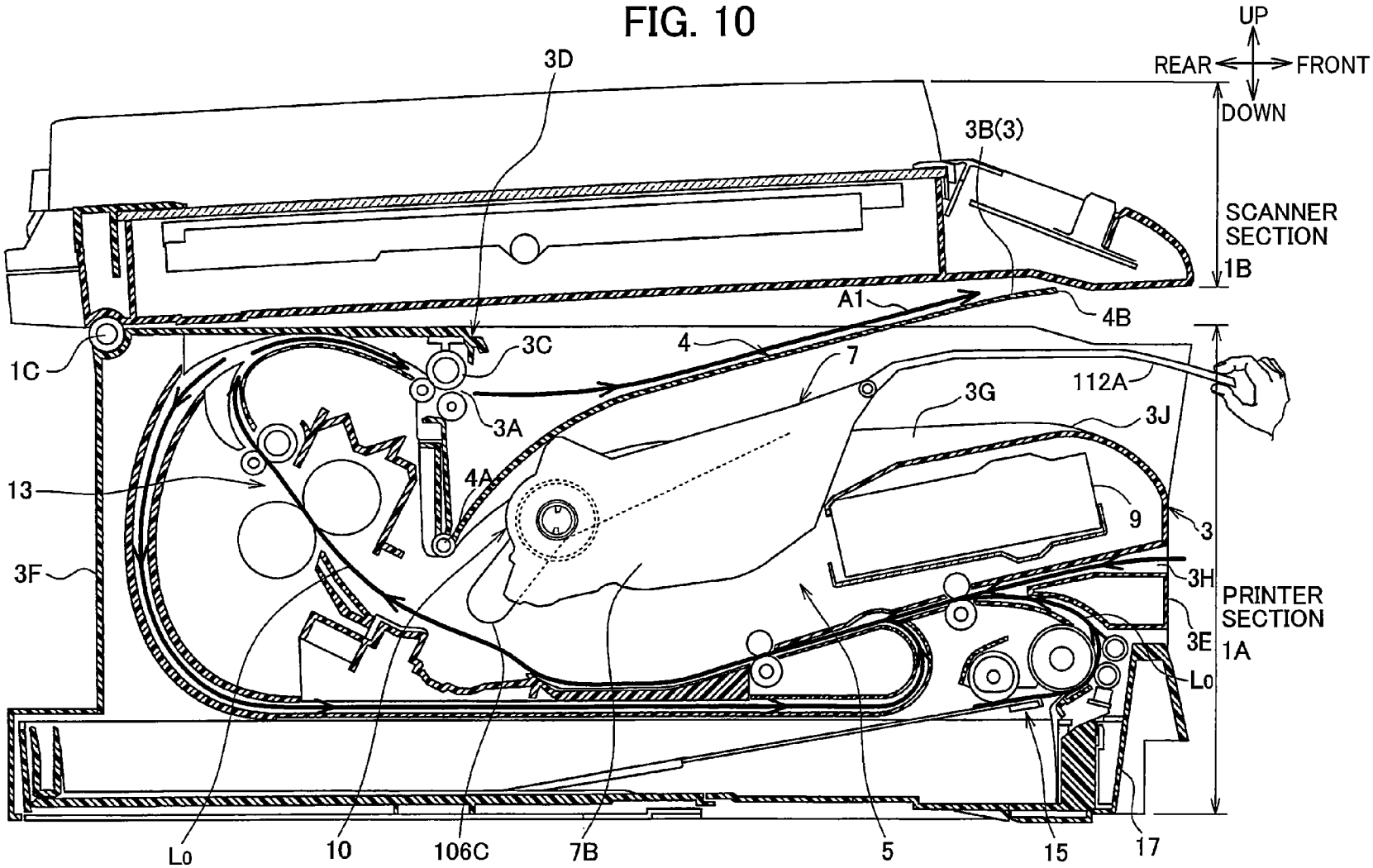
FIG. 10 is a central cross-sectional view of the image forming apparatus according to the second embodiment.
Figure 11:
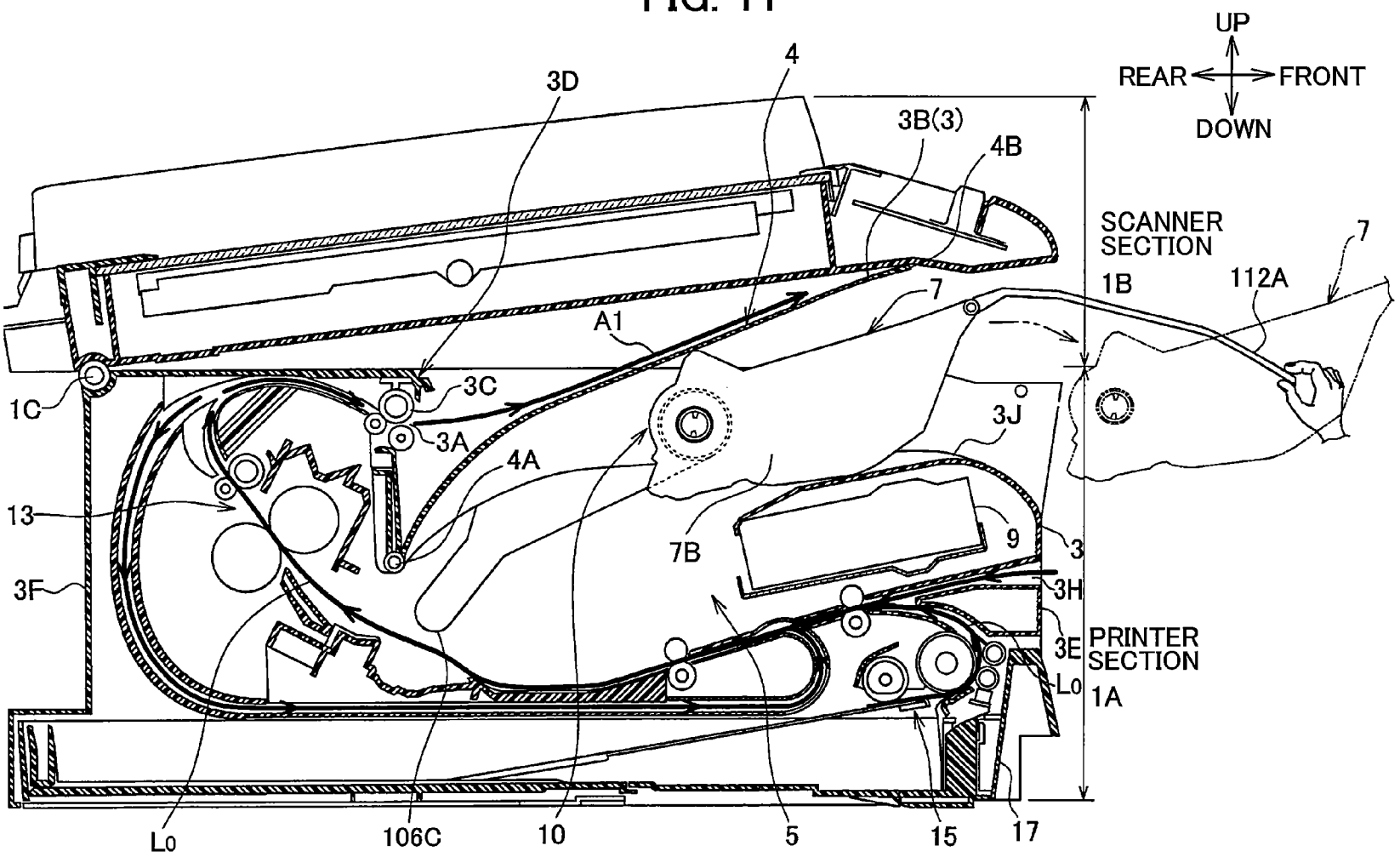
FIG. 11 is a central cross-sectional view of the image forming apparatus according to the second embodiment.

As illustrated in FIGS. 9 to 11, upon movement of the process unit 106 (support member 106A), the movable cover 4 is pressed from inside by the support member 106A to be automatically opened. Accordingly, the user can detach the support member 106A from the frame body without opening the movable cover 4.

A method of attaching the support member 106A to the frame body is the same as a method of attaching the developer cartridge 7 to the frame body. A second guide portion 106C (see FIG. 11) is provided in the frame body. When the support member 106A is attached to the frame body, the support member 106A is led to a predetermined position by the second guide portion 106C.

Incidentally, the present embodiment may have a configuration in which both the first and second holding portions 112A and 112B protrude outward from the movable cover 4.

Third Embodiment

Figure 12:
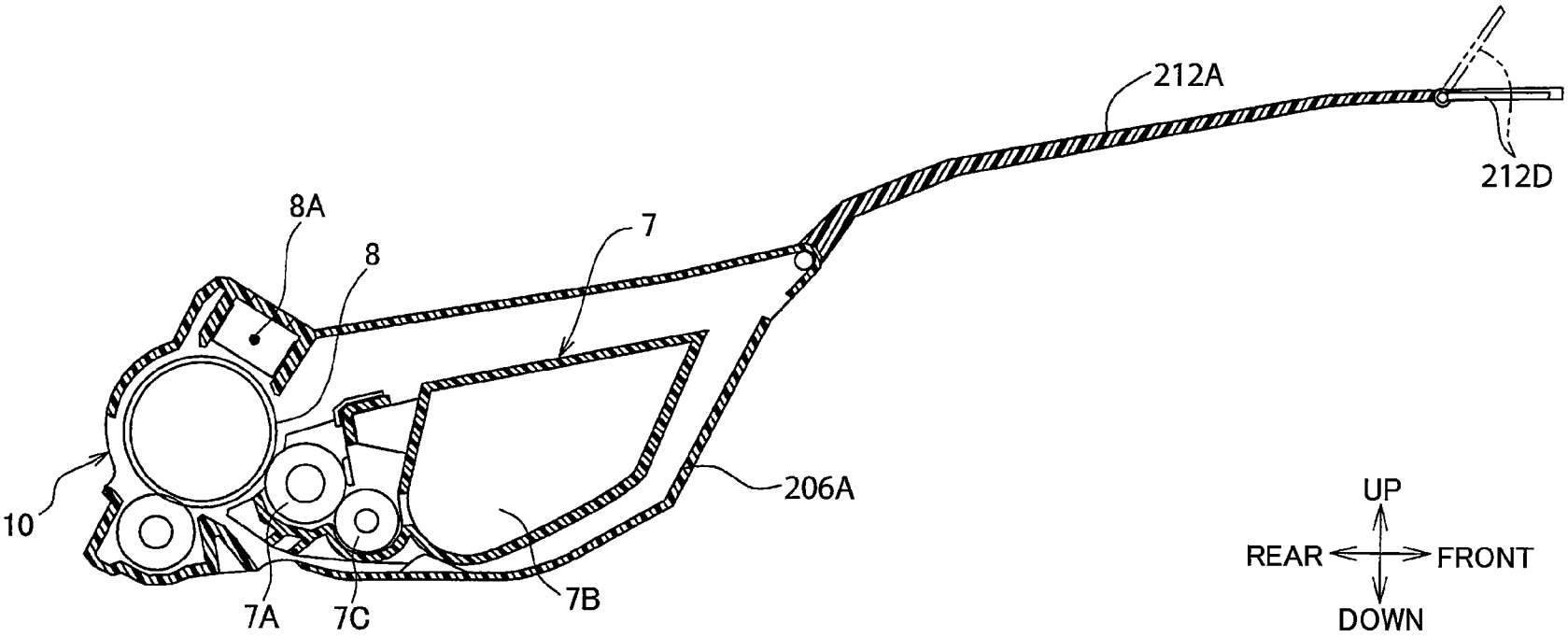
FIG. 12 is a cross-sectional view of a process unit according to a third embodiment.

In the above embodiments, the developer cartridge 7 is detachable from the process unit 206 (support member 206A). On the other hand, in the present embodiment, the developer cartridge 7 is an integral member including the support member 206A, and thus the developer cartridge 7 is not detachable from the support member 206A, as illustrated in FIG. 12.

In the present embodiment, the first holding portion 212A is provided to the support member 206A, while the second holding portion 12B is not provided.

OTHER EMBODIMENTS

According to the above embodiments, the sheet conveying path Lo forms an S-shape. However, this structure or configuration is not limited to this embodiment.

In the above embodiments, the regulation wall 12D, 112D, 212D is provided to the first holding portion 12A, 112A, 212A. However this structure or configuration is not limited to this configuration; alternatively, the regulation wall 12D, 112D, 212D may be omitted.

In the above embodiments, the first holding portion 12A, 112A, 212A constitutes a part of the sheet discharge tray 3B. However, this structure or configuration is not limited to this configuration.

According to the above embodiment, the movable cover 4 forms a part of the sheet discharge tray 3B. However, this structure or configuration is not limited to the embodiment.

Further, according to the above embodiment, the scanner section 1B is provided vertically upward of the printer section 1A. However, this structure or configuration is not limited to the embodiment. The image forming apparatus 1 may be configured without scanner section 1B.

While the description has been made in detail with reference to the embodiments thereof, it would be apparent to those skilled in the art that various changes and modifications may be made therein without departing from the spirit of the above described embodiments.

What is claimed is:

1. An image forming apparatus comprising:

a housing providing an opening portion defining an open end;

a sheet discharge tray configured to receive a sheet that has been running in a discharging direction and on which an image has been formed, the sheet discharge tray being movable between a closing position to close the open end and an opening position to open the open end, the sheet discharge tray defining the opening portion and having one end portion to define the open end;

a process unit configured to be attached to and detached from the housing through the opening portion, the process unit comprising a developer cartridge configured to accommodate therein developer; and a grip portion provided at the process unit, and having a protruding portion protruding outward between the open end of the housing and the one end portion of the sheet discharge tray when the process unit is attached to the housing and the sheet discharge tray is at the closing position.

2. The image forming apparatus according to claim 1, wherein the housing further provides a discharging opening configured to discharge the sheet; and wherein the sheet discharge tray has a hinge portion about which the sheet discharge tray is pivotably movable, the sheet discharge tray being positioned lower than the discharging opening.

3. The image forming apparatus according to claim 1, further comprising an exposure unit having a portion overlapping with the sheet discharge tray when viewed in a vertical direction.

4. An image forming apparatus comprising:

a housing providing an opening portion defining an open end;

a cover movable between a closing position to close the open end and an opening position to open the open end, the cover defining the opening portion and having one end portion to define the open end;

a process unit configured to be attached to and detached from the housing through the opening portion, the process unit comprising a developer cartridge configured to accommodate therein developer;

a grip portion provided at the process unit, and having a protruding portion protruding outward between the open end and the one end portion when the process unit is attached to the housing and the cover is at the closing position, the protruding portion having a protruding end positioned away from the exposure unit in the discharging direction when viewed in a vertical direction;

a photosensitive body disposed in the process unit and configured to carry developer thereon;

an exposure unit disposed lower than the grip portion and configured to scan and expose the photosensitive body to light;

a sheet supply tray disposed lower than the process unit and configured to accommodate sheets for being conveyed to the photosensitive body; and a sheet discharge tray disposed higher process unit and configured to receive a sheet that has been running in a discharging direction and on which an image has been formed, a sheet conveying path being provided from the sheet supply tray to the sheet discharge tray for conveying a sheet in a sheet conveying direction, the exposure unit being positioned downstream of the photosensitive body in the discharging direction.

5. The image forming apparatus according to claim 4, further comprising a sheet discharge tray configured to receive a sheet on which an image has been formed, the grip portion having a portion forming at least a part of the sheet discharge tray.

6. The image forming apparatus according to claim 5, wherein the grip portion comprises a regulation wall configured to regulate a movement of the sheet.

7. The image forming apparatus according to claim 5, wherein the portion of the grip portion forming at least the part of the sheet discharge tray has a width smaller than that of the sheet discharge tray.

8. The image forming apparatus according to claim 4, wherein the cover has another end portion pivotably connected to the housing, the one end portion of the cover being pivotally movable about the another end portion, the protruding portion being positioned adjacent to the one end portion.

9. The image forming apparatus according to claim 4, further comprising a sheet discharge tray configured to receive a sheet on which an image has been formed, the cover having a portion forming at least a part of the sheet discharge tray.

10. The image forming apparatus according to claim 4, wherein the sheet conveying path forms an S-shape when viewed in an imaginary vertical plane extending parallel to the discharging direction, the S-shape having a first bending portion at a position below the exposure unit and a second bending portion at a position downstream of the photosensitive body in the sheet conveying direction.

11. The image forming apparatus according to claim 4, wherein the process unit further comprises a support member, the developer cartridge being attachable to and detachable from the support member.

12. The image forming apparatus according to claim 11, wherein the grip portion is provided at the developer cartridge.

13. The image forming apparatus according to claim 11, wherein the grip portion is provided at the support member.

* * * * *